United States Patent [19]

Yang

[11] Patent Number: 4,741,511

[45] Date of Patent: May 3, 1988

[54] JACK HAVING ALTERNATE HYDRAULIC LIFTING AND AIR PUMP FUNCTIONS USING A COMMON DRIVE MOTOR

[76] Inventor: Tai-Her Yang, 5-1 Taipin St., Si-Hu Town, Dzan-Hwa, Taiwan

[21] Appl. No.: 896,269

[22] Filed: Aug. 14, 1986

[51] Int. Cl.[4] ..... B66F 3/24

[52] U.S. Cl. ..... 254/93 H; 254/1

[58] Field of Search ..... 60/435, 486, 400; 254/8 B, 93 H, 1, 89 H, 418, DIG. 2; 7/100; 74/15.6, 15.63

[56] References Cited

U.S. PATENT DOCUMENTS

| | | | |
|---|---|---|---|
| 1,698,189 | 1/1929 | Dunbar | 60/486 |
| 1,983,444 | 12/1934 | Dry | 254/423 |
| 2,034,605 | 3/1936 | Carman | 254/1 |
| 2,458,590 | 1/1949 | Harris et al. | 254/DIG. 2 |
| 2,916,880 | 12/1959 | Hann | 60/435 |
| 4,024,710 | 5/1977 | Zelle | 60/486 |

*Primary Examiner*—Robert C. Watson
*Attorney, Agent, or Firm*—Leonard Bloom

[57] ABSTRACT

A hydraulic jack adapted to provide an auxiliary air pumping function is disclosed. The jack has a hydraulically-actuated lifting mechanism, an air pump and a reversible electric motor having a drive shaft. A first clutch means operatively couples the drive shaft to the lifting mechanism. A second clutch means operatively couples the drive shaft to the air pump. Each of said clutch means are independently operable and are oppositely configured to one another, such that at any given time the drive shaft drives only one of either the lifting mechanism or the air pump respectively. Means are also provided for supplying power to the motor and for reversing operational driving direction of the motor. In a preferred embodiment, the clutch means are one-way clutch means.

6 Claims, 3 Drawing Sheets

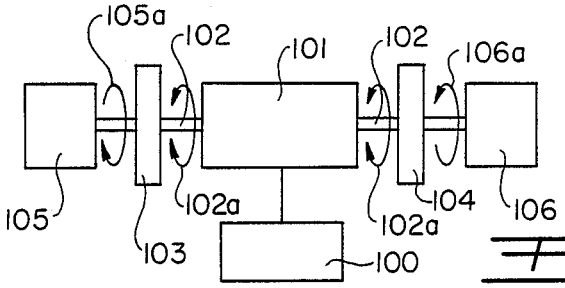
ig. 1
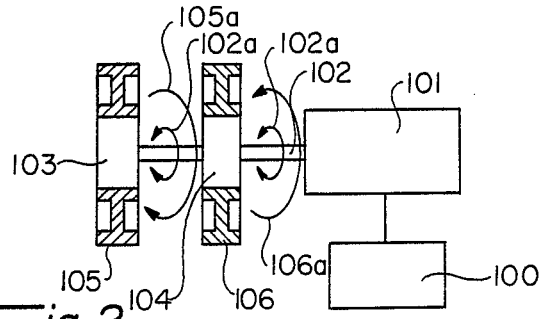
ig. 2
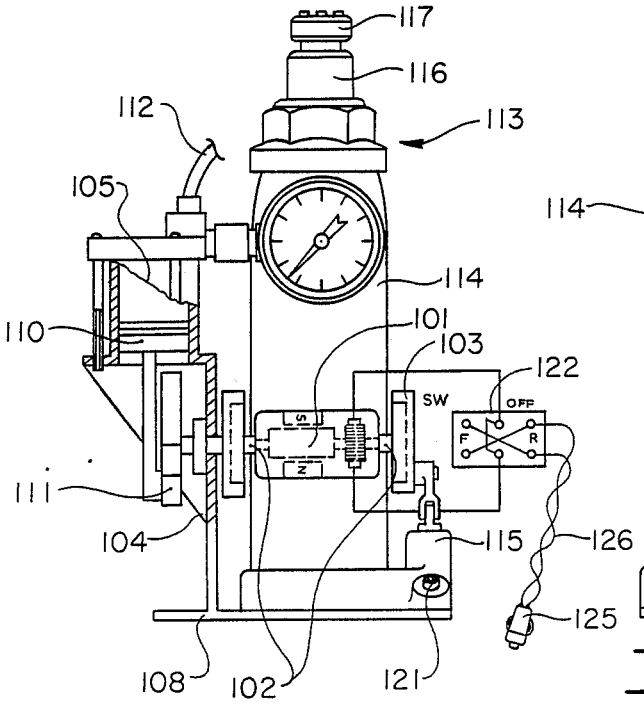
ig. 3
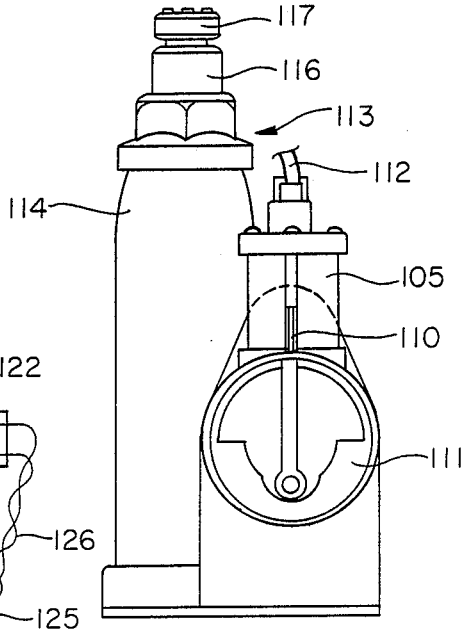
ig. 4

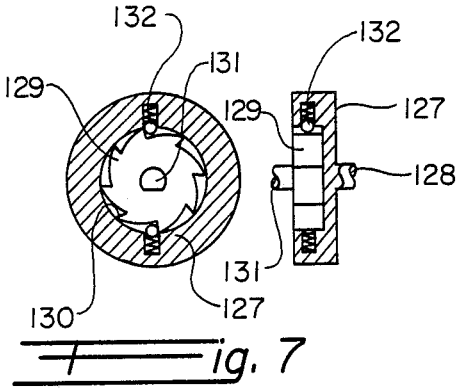
ig. 7
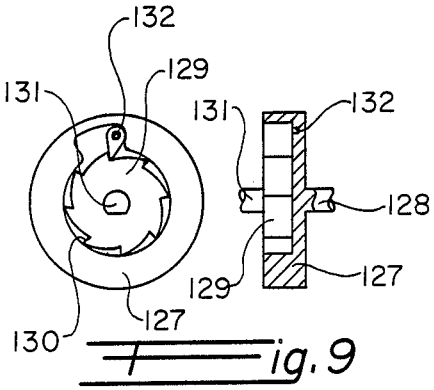
ig. 9
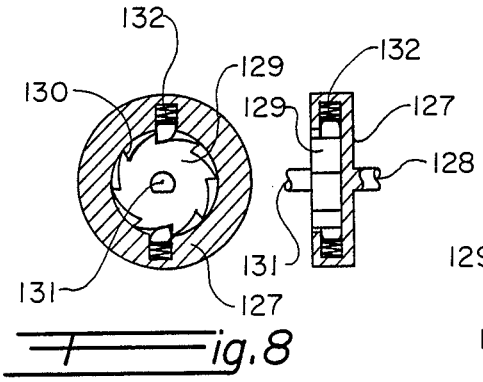
ig. 8
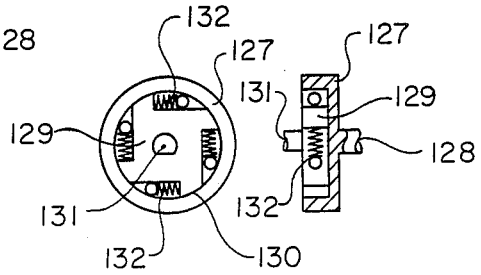
ig. 10

JACK HAVING ALTERNATE HYDRAULIC LIFTING AND AIR PUMP FUNCTIONS USING A COMMON DRIVE MOTOR

FIELD OF THE INVENTION

The present invention relates to jacks having separate pneumatic lifting and air pumping functions which are operated using a common drive motor and, more particularly to jacks having separate pneumatic jack lifting functions for raising and lowering an article such as a motor vehicle and air pumping functions for the inflating of tires wherein said functions are alternatively activated using a common drive motor.

BACKGROUND OF THE INVENTION

In jacks of which I am aware, that have separate pneumatic lifting and air pumping functions activated using a common drive motor, either both functions must be operated simultaneously or complicated gearing is required in order to be able to alternatively carry out said functions. The former case has the disadvantage of requiring both systems to be simultaneously operable at all times during use thereof. This often results in an undesired function occurring when only one function is desired. Such a disadvantage is, at best, bothersome and wasteful of motor power and, at worst, could result in damage to either the article (the vehicle) being worked upon or to the jack itself. The latter case has the disadvantage of requiring the use of complicated gearing which is not only expensive and hard to maintain, but which also takes up excessive space.

Thus, it will be appreciated that there remains a need for a jack having separate pneumatic lifting functions for raising and lowering an article such as a motor vehicle, and air pumping functions for the inflation of tires and the like, wherein both separate functions are without the need of complicated gearing, capable of being alternately activated using a common drive motor.

SUMMARY OF THE INVENTION

Accordingly, it is the primary objective of the present invention to alleviate the disadvantages and deficiencies of the prior art by providing a jack having separate pneumatic jack lifting and air pumping functions wherein both separate functions may be alternately activated and operated using a common reversible drive motor.

It is a further objective to provide such a jack that is operative without the need for use of complicated gearing.

In accordance with the teachings of the present invention, a hydraulic jack is provided. This hydraulic jack is adapted to provide an auxiliary air pumping function. This jack includes a hydraulically-activated lifting mechanism, an air pump, and a reversible electric motor having a shaft. A first clutch means is provided for coupling the shaft to the lifting mechanism. A second clutch means is provided for coupling the shaft to the air pump. The first and second clutch means are both independently operable and oppositely configured such that at any given time the shaft drives only one of the lifting mechanism and air pump respectively. Also, means is provided for reversing the motor.

In one embodiment, the means for reversing the motor is an electric switch. In a second embodiment, the first clutch means is a one-way clutch and the second clutch means is also a one-way clutch. In a further embodiment, the first clutch means is a ratchet and a pawl mechanism, and the second clutch means is also a ratchet and pawl mechanism. In still another embodiment, the shaft has one end portion projecting from the motor.

In further accordance with the teachings of the present invention, a hydraulic jack is provided. This jack is adapted to provide an auxiliary air pumping function. This jack includes a hydraulically-actuator lifting mechanism, an air pump, and a reversible electric motor. A double-end drive shaft is carried by the motor. Said shaft has respective end portions projecting therefrom. A first clutch means is provided for coupling the lifting mechanism to one of the end portions of the shaft. A second clutch means is provided for coupling the air pump to the other opposite end portion of the shaft. The first and second clutch means are both independently operable and oppositely configured, such that at any given time the shaft drives only one of the lifting mechanisms and air pump respectively. Also, means is provided for reversing the motor.

In one embodiment, the means for reversing the motor is an electric switch. In a second embodiment, the first clutch means is a one-way clutch and the second clutch means is also a one-way clutch. In a further embodiment, the first clutch means is a ratchet and pawl mechanism and the second clutch means is also a ratchet and pawl mechanism.

In still further accordance with the teachings of the present invention, a hydraulic jack for lifting and lowering an article is provided. This jack has a frame. A main body is positioned on the frame. A reversible drive motor is positioned in the body. An elongated motor drive shaft is carried by the motor and is projecting therefrom. Said drive shaft is rotatably driven by the motor in one of either the first direction or the second opposite direction. An air pump having a piston is positioned in the body. A second, one-way clutch means is provided for operatively connecting the piston and the motor drive shaft. An oil pump is carried by the frame. A lifting means is provided which includes a stand shaft driven by the oil pump and a top block which is driven by the stand shaft for lifting the article. Also, drain control means are provided for the air pump and the oil pump, respectively. A first one-way clutch means is provided for operatively connecting the oil pump and the motor drive shaft. Said second one-way clutch means and said first one-way clutch means are both independently operable and oppositely configured, such that at any given time the drive shaft drives only one of either the air pump or the oil pump, respectively. Also, a switch means is provided for switching the operation of the drive motor for driving the shaft between its first direction and its second opposite direction.

In one embodiment, the first one-way clutch means is a ratchet-and-pawl mechanism, and the second one-way clutch means is also a ratchet-and-pawl mechanism. In a second embodiment, the shaft has one end portion projecting from the motor. In another embodiment, the reversible drive motor is a direct circuit motor. In yet another embodiment, means is provided for electrically connecting the drive motor to an outlet carried by a motor vehicle having an electrical system, whereby electric power supplied by the electrical system of the motor vehicle is provided to the motor for the operation thereof.

In yet further accordance with the teachings of the present invention, a hydraulic jack for lifting and lowering an article is provided. This jack has a frame. A main body is positioned on the frame. A reversible drive motor is positioned in the body. An elongated double-ended motor drive shaft is carried by the motor. This shaft has respective end portions projecting from the motor. Said drive shaft is rotatably driven by the motor in one of either the first direction and the second opposite direction. An air pump is provided. This air pump has a piston positioned in the body. A second clutch means is provided for operatively connecting the piston to one end of the motor drive shaft. An oil pump is carried by the frame. A lifting means is provided which includes a stand shaft driven by the oil pump and a top block which is driven by the stand shaft for lifting the article. Drain control means are provided for the air pump and the oil pump, respectively. A first clutch means provides for operatively connecting the oil pump and the other opposite end of the motor drive shaft. Said second clutch means and said first clutch means are both independently operable and are oppositely configured such that, at any given time, the drive shaft drives only one of either the air pump or the oil pump, respectively. Also, a switch means is provided for switching the operation of the drive motor for driving the shaft between its first direction and its second opposite direction.

In one embodiment the first clutch means is a one-way clutch and the second clutch means is also a one-way clutch. In a second embodiment, the first one-way clutch is a ratchet and pawl mechanism, and the second one-way clutch is also a ratchet and pawl mechanism. In another embodiment, the reversible drive motor is a direct current motor. In this embodiment, there is also means provided for electrically connecting the drive motor to an outlet carried by a motor vehicle, having an electrical system, whereby electric power supplied by the electrical system of the motor vehicle is provided to the motor for the operation thereof.

BRIEF DESCRIPTION OF THE DRAWINGS

FIG. 1 is a schematic diagram, in block form, of the jack of the present invention provided with a drive shaft having respective end portions thereof emerging from the motor.

FIG. 2, is a schematic diagram, in block form of the jack of the present invention provided with a drive shaft having only one end portion thereof emerging from the motor.

FIG. 3, is a side view of the system which provides both the hydraulic and pneumatic functions, removed from the jack for the sake of clarity.

FIG. 4, is a side view of the system of FIG. 3.

FIG. 7, is one example of a clutch means which may be employed by the present invention.

FIG. 8, is a second example of a clutch means which may be employed by the present invention.

FIG. 9, is still another example of a clutch means which may be employed by the present invention.

FIG. 10 is yet another example of a clutch means which may be employed by the present invention.

DESCRIPTION OF THE PREFERRED EMBODIMENTS

Figure 5:
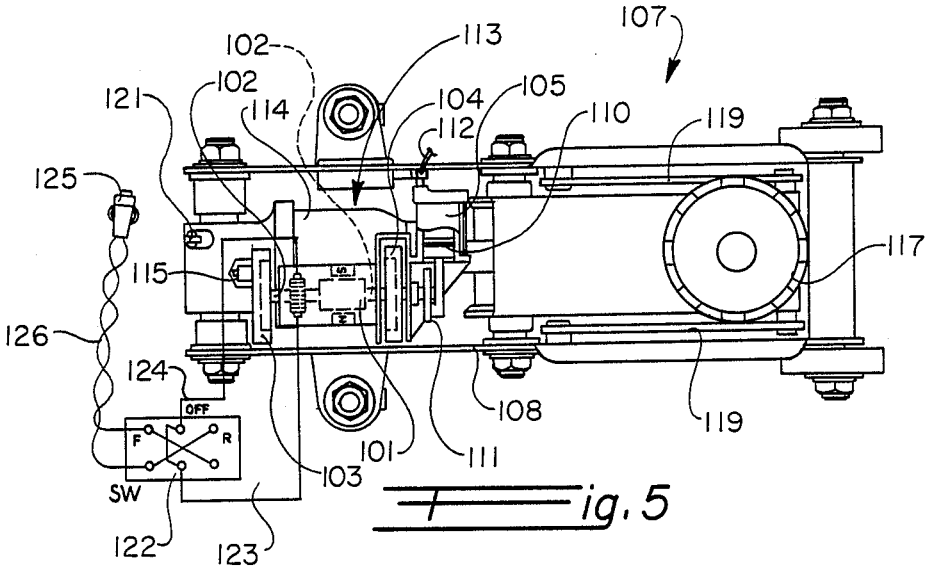
FIG. 5, is a top plan view of a jack of the present invention.

Referring now to the drawings, FIG. 1 illustrates the arrangement of the present invention wherein a power source 100 provides power to a reversible motor 101 which carries a drive shaft 102 having respective end portions emerging therefrom. The drive shaft 102 is rotatably carried by the motor 101 for movement in either a first or a second opposite direction, as indicated by the arrows 102*a*. Positioned on both respective ends of shaft 102 are first clutch means 103 and second clutch means 104. Finally, the hydraulic pumping system (hydraulically-activated lifting mechanism) 105 and the pneumatic pumping system (air pump) 106 are operatively coupled by pistons to the shaft 102 by clutch means 103 and 104, respectively. As shown by arrows 105*a* and 106*a* respectively, clutch means 103 and 104 are independently operable and are oppositely configured, such that at any given time the shaft 102 drives only one of either the lifting mechanism 105 or the air pump 106.

Referring now to FIG. 2, if desired, the present invention may also be arranged so that a power source 100 provides power to a reversible motor 101 which carries a drive shaft 102 having only one end portion emerging therefrom. Once again, the drive shaft 102 is rotatably carried by the motor 101 for movement in both a first and a second opposite direction as indicated by arrows 102*a*. Positioned on shaft 102 are first clutch means 103 and second clutch means 104. A hydraulic pumping system (a hydraulically-activated lifting mechanism) 105 and a pneumatic pumping system (an air pump) 106 are operatively coupled to the shaft 102 by clutch means 103 and 104, respectively. As shown by arrows 105*a* and 106*a* respectively, clutch means 103 and 104 are independently operable and are oppositely configured, such that at any given time the shaft drives only one of either the lifting mechanism 105 or the air pump 106.

Figure 6:
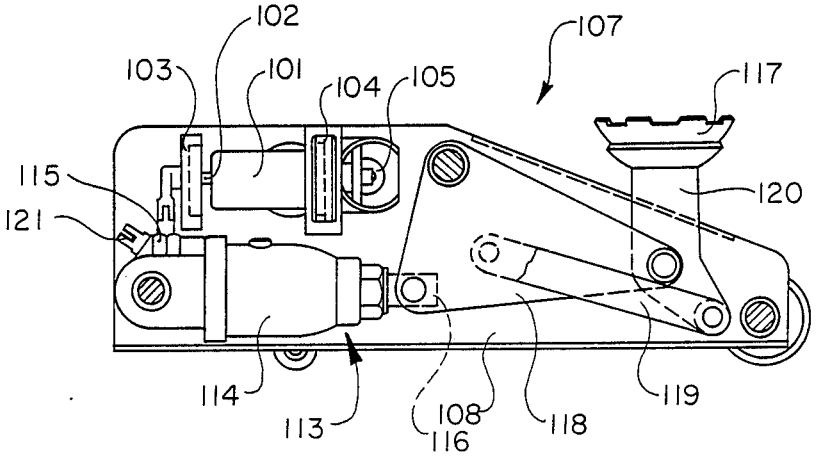
FIG. 6, is a side view of the jack of FIG. 5.

With reference now to FIGS. 1, 3, 4, 5 and 6 the system that controls the functions of hydraulic lifting and lowering as well as the system that controls the functions of pneumatic air pumping are illustrated both as removed from the jack (FIGS. 3 and 4) and as they are disposed within the jack (FIGS. 5 and 6). The jack 107 is of the wheeled-carriage type having a frame 108. Secured to the frame 108, and carried thereby, is an electric reversible drive motor 101. Said motor may be of the type which is operable on either a.c. power or d.c. power, although as will be understood by those skilled in the art, and as illustrated, the d.c. motor is preferred.

Carried by the motor 101 is motor drive shaft 102. As illustrated, motor drive shaft 102 is rotatably mounted (by any suitable means) in and is driven by the motor 101 in one of a first direction or a second opposite direction. As illustrated, said drive shaft 102 is a double-ended shaft having respective end portions projecting from the motor 101. However, as will be understood by those skilled in the art, the shaft 102 may also be a single ended shaft having only one end portion projecting from the motor 101 (FIG. 2).

Also positioned on the frame 108 is an air pump (pneumatic pumping system) 105 having a piston 110 disposed therein. The piston 110 is suitably secured to an eccentrical motion translation mechanism 111, so that operative rotational movement of the shaft 102 will be translated into the pumping action necessary to operate the piston 110. Finally, the piston 110 is operatively connected, via mechanism 111 to the motor drive shaft 102 by second one-way clutch means 104. While illustrated as a one-way clutch means, it shall be understood by those skilled in the art, that any suitable clutch means may be utilized. Air pressure produced by the operative action of piston 110 is then pumped out of the piston 110 and is carried by air hose 112 to the point of usage. In this manner, air for, inter alia, the inflation of flat tires is provided.

A lifting means 113 is also provided for the raising and lowering of an article such as a motor vehicle or the like. Lifting means 113 is operated by an oil pump (hydraulic pumping system) 105 being operatively connected to the drive shaft 102 by a first one-way clutch means 103. Said lifting means is comprised of a hydraulic cylinder 114 having a piston (not shown) disposed therein, means 115 for actuating the piston, a stand shaft 116 driven by the piston and a top block 117 carried by the stand shaft 116.

As will be understood by those skilled in the art, when disposed in the jack 107, it is possible that, if desired, the top block may not be carried by, or directly driven by, the stand shaft 116. Rather, the stand shaft 116 may drive a lever 118 which translates its motion via link 119 to a lift 120 which carries the top block (saddle) 117 thereon. (See FIGS. 5 and 6).

Separate drain control means 121 are also provided for the air pump and the oil pump respectively.

While clutch means 103 has been illustrated and described as a one-way clutch means, as will be understood by those skilled in the art, any suitable clutch means may be employed.

It should be noted that the first and the second clutch means (103 and 104, respectively) are both operable independent of each other and are oppositely configured, such that at any given time, the drive shaft 102 drives only one of either the air pump or the oil pump.

The direction of operation of the motor 101 and means for reversing said direction of operation is controlled by a switch means 122. Switch means 122 is electrically connected to the motor 101 via electrical wires 123 and 124, although any suitable means may be employed. Connected thusly, switch means 122 provides for changing the operation of the drive motor so that the shaft may be driven between its first direction and its second opposite direction.

Finally, the motor 101 is electrically connected to an external power source 100 through a plug means 125 and switch means 122, respectively. Plug means 125 is electrically connected to switch means 122 via electrical wires 126. Connected thusly, power supplied from an external power source 100 (such as the electrical system of a motor vehicle) is provided to the motor 101 via plug 125, wires 126, switch means 122 and wires 123 and 124, respectively, for the operation thereof.

Any number of clutch means, and in particular one-way clutch means, may be employed consonant with the teachings of the present invention. Preferably, such clutch means can be any one of a number of ratchet and pawl mechanisms available. With reference now to FIGS. 7–10, such mechanisms all include a clutch housing 127 having a centrally positioned shaft 128 integral therewith. Positioned within said housing 127 is a ratchet wheel 129 having ratchet teeth 130 spaced about the periphery thereof. Said ratchet wheel 129 is rotatably connected to a second centrally positioned shaft 131 for rotational movement therewith. Carried by housing 127 is a pawl mechanism 132 which provides the clutch with its one-way action. Said pawl mechanism 131 may be of the ball-spring detent variety (FIGS. 7, 9 and 10), of the resiliently-biased pivotably-mounted hooking member variety (FIG. 8) or of any other suitable variety.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In a hydraulic jack of the type adapted to provide an auxiliary air pumping function, and having a hydraulically-actuated lifting mechanism, and an air pump, the improvement thereupon comprising, in combination: a reversible electric motor, a double-ended drive shaft being carried by the motor having respective end portions projecting therefrom, said drive haft being rotatably driven by the motor in, alternatively, one of a first direction and a second opposite direction, a first one-way clutch means for coupling the lifting mechanism to one of the end portions of the shaft, a second one-way clutch means for coupling the air pump to the other opposite end portion of the shaft, the first and second one-way clutch means being independently operable and oppositely configured, such that at any given time the rotation of the shaft drives only one of the lifting mechanism and air pump respectively, and means for reversing the motor.

2. The hydraulic jack of claim 1, wherein the means for reversing the motor is an electric switch.

3. The hydraulic jack of claim 1, wherein the first one-way clutch is a ratchet and pawl mechanism, and further wherein the second one-way clutch is a ratchet and pawl mechanism.

4. A hydraulic jack for lifting and lowering an article, in combination, comprised of:

a frame;

a reversible drive motor carried by the frame;

an elongated, double-ended motor drive shaft carried by the motor having respective end portions projecting therefrom, said drive shaft being rotatably driven by the motor in, alternatively, one of a first direction and a second opposite direction;

an oil pump carried by the frame;

a lifting means, including a stand shaft driven by the oil pump, and a top block driven by the stand shaft for lifting the article;

a first one-way clutch means for operatively connecting the oil pump and the other, opposite, end of the motor drive shaft;

an air pump having a piston positioned in the body;

a second one-way clutch means for operatively connecting the piston to one end of the motor drive shaft, said first one-way clutch means and said second one-way clutch means being independently operable and oppositely configured such that, at any given time, the rotation of the drive shaft drives only one of the oil pump and air pump respectively;

drain control means for the air pump and the oil pump respectively; and a switch means for switching the operation of the drive motor for driving the shaft between its first direction and its second opposite direction.

5. The hydraulic jack of claim 4, wherein the first one-way clutch is a ratchet and pawl mechanism, and further wherein the second one-way clutch is a ratchet and pawl mechanism.

6. The hydraulic jack of claim 4, wherein the reversible drive motor is a direct current motor, and further comprising means for electrically connecting the drive motor to an outlet carried by a motor vehicle, having an electrical system, whereby electric power supplied by the electrical system of the motor vehicle is provided to the motor for the operation thereof.

* * * * *